US009358783B2

(12) United States Patent
Korthuis

(10) Patent No.: US 9,358,783 B2
(45) Date of Patent: Jun. 7, 2016

(54) FLUID EJECTION DEVICE AND METHOD OF FORMING SAME

(75) Inventor: Vincent C Korthuis, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1024 days.

(21) Appl. No.: 13/457,910

(22) Filed: Apr. 27, 2012

(65) Prior Publication Data

US 2013/0286083 A1 Oct. 31, 2013

(51) Int. Cl.
*B41J 2/14* (2006.01)
*B41J 2/16* (2006.01)

(52) U.S. Cl.
CPC ..... *B41J 2/14129* (2013.01); *B41J 2/1412* (2013.01); *B41J 2/14016* (2013.01); *B41J 2/14088* (2013.01); *B41J 2/14112* (2013.01); *B41J 2/1603* (2013.01); *B41J 2/1626* (2013.01); *B41J 2/1631* (2013.01); *Y10T 29/49401* (2015.01)

(58) Field of Classification Search
CPC ..... B41J 2/14112; B41J 2/14129; B41J 2/14088; B41J 2/14016; B41J 2/1626; B41J 2/1631; B41J 2/1603; B41J 2/1412
See application file for complete search history.

(56) References Cited

U.S. PATENT DOCUMENTS 7,073,891 B2 7/2006 Shin et al.
2001/0043243 A1* 11/2001 Tachihara ..... B41J 2/14056 347/15
2002/0008737 A1* 1/2002 Inui ..... B41J 2/1404 347/56
2002/0024561 A1* 2/2002 Sugioka ..... B41J 2/04518 347/57
2007/0081032 A1* 4/2007 Silverbrook ..... B41J 2/1404 347/56
2008/0198202 A1 8/2008 Shaarawi et al.
2008/0231664 A1* 9/2008 Murakami ..... B41J 2/1404 347/56
2009/0027429 A1* 1/2009 Jung ..... B41J 2/04506 347/10
2009/0040276 A1* 2/2009 North ..... B41J 2/1404 347/56
2009/0096839 A1* 4/2009 Olbrich ..... B41J 2/1404 347/62
2009/0315945 A1* 12/2009 Oikawa ..... B41J 2/14112 347/44
2010/0110142 A1* 5/2010 Kwon ..... B41J 2/1603 347/44
2010/0163517 A1 7/2010 Wang et al.
2012/0098887 A1* 4/2012 Xie ..... B41J 2/14016 347/44
2012/0098890 A1* 4/2012 Xie ..... B41J 2/14112 347/54

FOREIGN PATENT DOCUMENTS

EP 0785072 A2 * 7/1997 ..... B41J 2/14056
WO 2010134910 A1 11/2010

* cited by examiner

*Primary Examiner* — Justin Seo
(74) *Attorney, Agent, or Firm* — Dicke, Billig & Czaja, PLLC

(57) ABSTRACT

A method of forming a fluid ejection device includes providing a substrate having a first side supporting an oxide layer and a conductive layer over the oxide layer; and patterning the conductive layer to define an area for an actuator of the fluid ejection device, including shaping the area with first and second ends each having a first width and at least one portion between the first and second ends having a second width less than the first width.

20 Claims, 4 Drawing Sheets

FLUID EJECTION DEVICE AND METHOD OF FORMING SAME

BACKGROUND

An inkjet printing system, as one example of a fluid ejection system, may include a printhead, an ink supply which supplies ink to the printhead, and an electronic controller which controls the printhead. The printhead, as one example of a fluid ejection device, ejects drops of ink through a plurality of nozzles or orifices and toward a print medium, such as a sheet of paper, so as to print onto the print medium. Typically, the orifices are arranged in one or more columns or arrays such that properly sequenced ejection of ink from the orifices causes characters or other images to be printed upon the print medium as the printhead and the print medium are moved relative to each other.

Fabrication of the printhead may include a mixture of integrated circuit and MEMS techniques such as a combination of etching and photolithography processes. Unfortunately, the combination of such processes may result in undesired artifacts. For example, overetching may result in damaged or scarred areas which, in turn, may cause unintended light scatter during UV exposure and, therefore, may create deformities and/or residue during fabrication of the printhead.

DETAILED DESCRIPTION

In the following detailed description, reference is made to the accompanying drawings which form a part hereof, and in which is shown by way of illustration specific examples in which the disclosure may be practiced. In this regard, directional terminology, such as "top," "bottom," "front," "back," "leading," "trailing," etc., is used with reference to the orientation of the Figure(s) being described. Because components of examples of the present disclosure can be positioned in a number of different orientations, the directional terminology is used for purposes of illustration and is in no way limiting. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Figure 1:
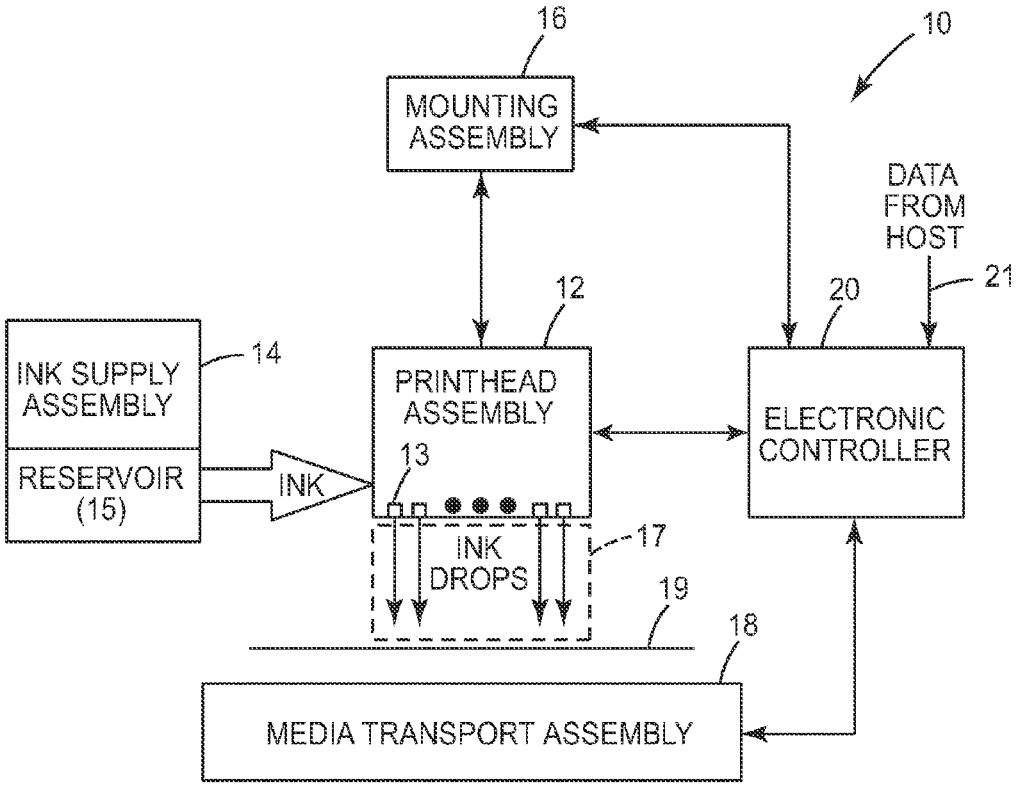
FIG. 1 is a block diagram illustrating one example of a fluid ejection system.

FIG. 1 illustrates one example of an inkjet printing system 10. Inkjet printing system 10 constitutes one example of a fluid ejection system which includes a fluid ejection assembly, such as an inkjet printhead assembly 12, and a fluid supply assembly, such as an ink supply assembly 14. In the illustrated example, inkjet printing system 10 also includes a mounting assembly 16, a media transport assembly 18, and an electronic controller 20.

Inkjet printhead assembly 12, as one example of a fluid ejection assembly, includes one or more printheads or fluid ejection devices which eject drops of ink or fluid through a plurality of orifices or nozzles 13. In one example, the drops are directed toward a medium, such as print medium 19, so as to print onto print medium 19. Print medium 19 is any type of suitable sheet material, such as paper, card stock, transparencies, Mylar, fabric, and the like. Typically, nozzles 13 are arranged in one or more columns or arrays such that properly sequenced ejection of ink from nozzles 13 causes, in one example, characters, symbols, and/or other graphics or images to be printed upon print medium 19 as inkjet printhead assembly 12 and print medium 19 are moved relative to each other.

Ink supply assembly 14, as one example of a fluid supply assembly, supplies ink to inkjet printhead assembly 12 and includes a reservoir 15 for storing ink. As such, in one example, ink flows from reservoir 15 to inkjet printhead assembly 12. In one example, inkjet printhead assembly 12 and ink supply assembly 14 are housed together in an inkjet or fluid-jet cartridge or pen. In another example, ink supply assembly 14 is separate from inkjet printhead assembly 12 and supplies ink to inkjet printhead assembly 12 through an interface connection, such as a supply tube.

Mounting assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one example, inkjet printhead assembly 12 is a scanning type printhead assembly and mounting assembly 16 includes a carriage for moving inkjet printhead assembly 12 relative to media transport assembly 18. In another example, inkjet printhead assembly 12 is a non-scanning type printhead assembly and mounting assembly 16 fixes inkjet printhead assembly 12 at a prescribed position relative to media transport assembly 18.

Electronic controller 20 communicates with inkjet printhead assembly 12, mounting assembly 16, and media transport assembly 18. Electronic controller 20 receives data 21 from a host system, such as a computer, and may include memory for temporarily storing data 21. Data 21 may be sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one example, electronic controller 20 provides control of inkjet printhead assembly 12 including timing control for ejection of ink drops from nozzles 13. As such, electronic controller 20 defines a pattern of ejected ink drops which form characters, symbols, and/or other graphics or images on print medium 19. Timing control and, therefore, the pattern of ejected ink drops, is determined by the print job commands and/or command parameters. In one example, logic and drive circuitry forming a portion of electronic controller 20 is located on inkjet printhead assembly 12. In another example, logic and drive circuitry forming a portion of electronic controller 20 is located off inkjet printhead assembly 12.

Figure 2:
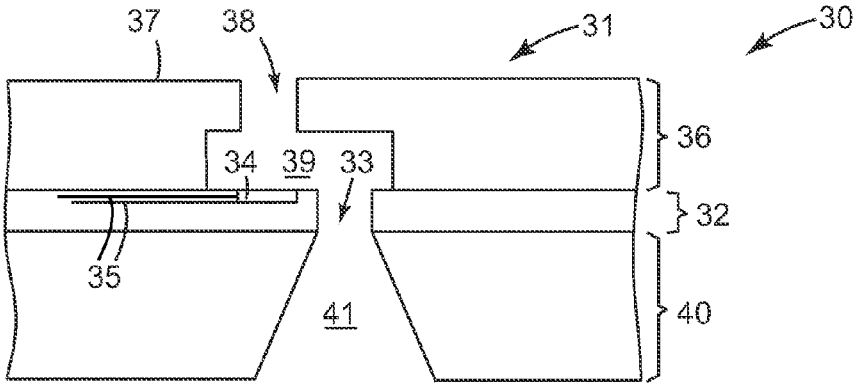
FIG. 2 is a schematic cross-sectional view illustrating one example of a portion of a fluid ejection device.

FIG. 2 illustrates one example of a portion of a fluid ejection device 30. Fluid ejection device 30 includes an array of drop ejecting elements 31. Drop ejecting elements 31 are formed on a substrate 40 which has a fluid (or ink) feed slot 41 formed therein. As such, fluid feed slot 41 provides a supply of fluid (or ink) to drop ejecting elements 31. Substrate 40 is formed, for example, of silicon, glass, or ceramic.

In one example, each drop ejecting element 31 includes a thin-film structure 32 with a resistor 34, as an example of an actuator for fluid ejection device 30, and an orifice/barrier layer 36. Thin-film structure 32 has a fluid (or ink) feed hole 33 formed therein which communicates with fluid feed slot 41 of substrate 40. Orifice/barrier layer 36 has a front face 37 and an orifice or nozzle opening 38 formed in front face 37. Orifice/barrier layer 36 also has a fluid chamber 39 formed therein which communicates with nozzle opening 38 and fluid feed hole 33 of thin-film structure 32. Resistor 34 is positioned within fluid chamber 39 and includes leads 35 which electrically couple resistor 34 to a drive signal and ground.

Thin-film structure 32 includes one or more oxide, passivation, or insulation layers formed, for example, of silicon dioxide, silicon carbide, silicon nitride, tantalum, poly-silicon glass, tetraethylorthosilicate (TEOS), or other material. In one example, thin-film structure 32 also includes one or more conductive layers which define resistor 34 and leads 35. The conductive layers are formed, for example, of aluminum, gold, tantalum, tantalum-aluminum, or other metal or metal alloy.

Orifice/barrier layer 36 (including nozzle openings 38 and fluid chambers 39) includes one or more layers of material compatible with the fluid (or ink) to be routed through and ejected from fluid ejection device 30. Material suitable for orifice/barrier layer 36 includes, for example, a photo-imageable polymer such as SU8.

In one example, during operation, fluid flows from fluid feed slot 41 to fluid chamber 39 via fluid feed hole 33. Nozzle opening 38 is operatively associated with resistor 34 such that droplets of fluid are ejected from fluid chamber 39 through nozzle opening 38 (e.g., normal to the plane of resistor 34) and toward a medium upon energization of resistor 34. More specifically, in one example, fluid ejection device 30 comprises a fully integrated thermal inkjet (TIJ) printhead, and ejects drops of fluid from nozzle opening 38 by passing an electrical current through resistor 34 so as to generate heat and vaporize a portion of the fluid within fluid chamber 39 such that another portion of the fluid is ejected through nozzle opening 38.

Figure 3:
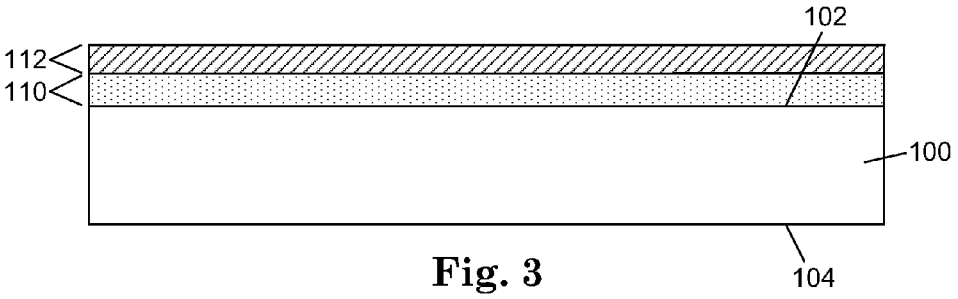
FIGS. 3-8 schematically illustrate one example of aspects of forming a fluid ejection device.

FIGS. 3-8 schematically illustrate one example of aspects of forming a fluid ejection device, such as fluid ejection device 30 (FIG. 2). As illustrated in FIG. 3, substrate 100, as an example of substrate 40 (FIG. 2), has a first side 102 and second side 104. Second side 104 is opposite first side 102 and, in one implementation, orientated substantially parallel with first side 102. In one example, first side 102 forms a front side of substrate 100 and second side 104 forms a backside of substrate 100. As such, with a fluid feed slot or opening formed through substrate 100 (see, e.g., fluid feed slot 41 (FIG. 2)), fluid flows through substrate 100 from the backside to the front side.

In one example, substrate 100 is formed of silicon and, in some implementations, may comprise a crystalline substrate such as doped or non-doped monocrystalline silicon or doped or non-doped polycrystalline silicon. Other examples of suitable substrates include gallium arsenide, gallium phosphide, indium phosphide, glass, silica, ceramics, or a semiconducting material.

In one example, formation of the fluid ejection device includes forming a thin-film structure, such as thin-film structure 32 (FIG. 2), on first side 102 of substrate 100. As described above, the thin-film structure includes one or more oxide, passivation, or insulation layers formed, for example, of silicon dioxide, silicon carbide, silicon nitride, tantalum, poly-silicon glass, tetraethylorthosilicate (TEOS), or other material. In addition, the thin-film structure also includes one or more conductive layers which define a resistor and corresponding conductive paths or leads, such as resistor 34 and corresponding leads 35 (FIG. 2). The conductive layers are formed, for example, of aluminum, gold, tantalum, tantalum-aluminum, or other metal or metal alloy.

As illustrated in the example of FIG. 3, an oxide layer 110, as one layer of the thin-film structure, is formed on first side 102 of substrate 100, and a conductive layer 112, as another layer of the thin-film structure, is formed over oxide layer 110. In one implementation, oxide layer 110 includes TEOS, and conductive layer 112 includes aluminum.

Figure 4:
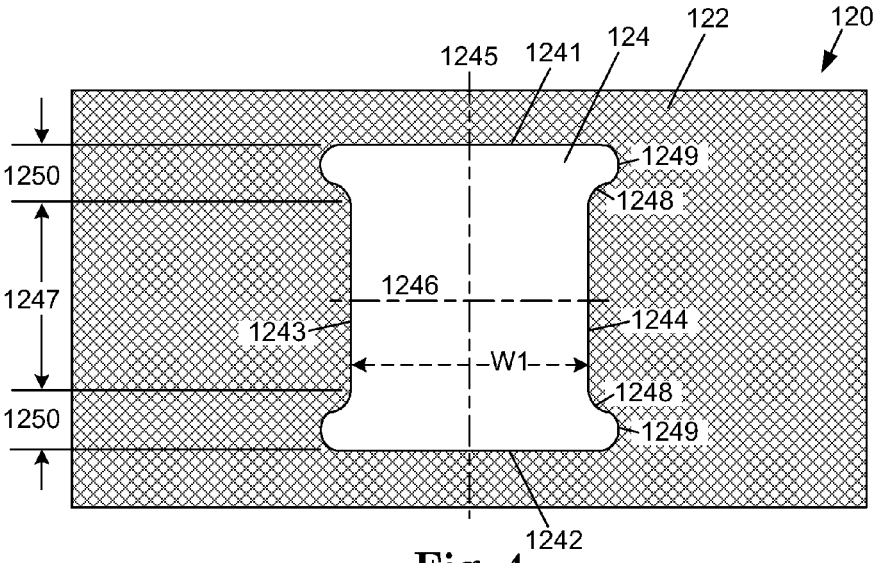

FIG. 4 is a schematic plan view of one example of a mask layer 120 used to define an area for a thermal resistor of the fluid ejection device, such as resistor 34 of fluid ejection device 30 (FIG. 2). More specifically, mask layer 120 is formed over conductive layer 112, and is patterned to expose a portion (or portions) of conductive layer 112 to be removed before forming the thermal resistor. In one example, the exposed portion (or portions) of conductive layer 112 is removed by chemical etching. In one example, mask layer 120 is formed of photoresist and patterned using photolithography techniques, and the etch is a dry etch, such as a plasma-based fluorine (SF6) etch. As such, mask layer 120 represents an etch mask 122 that is patterned to define an etch window 124 through which material of conductive layer 112 (FIG. 3) is removed.

As illustrated in the schematic plan view of FIG. 4, etch window 124 of etch mask 122 has opposite ends 1241 and 1242, and opposite sides 1243 and 1244. In addition, etch window 124 of etch mask 122 has a first axis 1245 extended along a length thereof between opposite ends 1241 and 1242, and has a second axis 1246 extended along a width thereof between opposite sides 1243 and 1244.

In one example, etch window 124 has a reduced width portion 1247 provided between opposite ends 1241 and 1242 along the length thereof. More specifically, reduced width portion 1247 constitutes a narrower width portion relative to and extending between wider width portions 1250 provided at opposite ends 1241 and 1242 of etch window 124. As such, in the illustrated example, etch window 124 has an I-shaped profile with reduced width portion 1247 representing a "body" of the I-shaped profile, and opposite ends 1241 and 1242 representing "arms" of the I-shaped profile. In one example, etch window 124 has radiussed portions 1248 provided at each end of reduced width portion 1247, and has radiussed portions 1249 provided at wider width portions 1250 of opposite ends 1241 and 1242.

Figure 5:
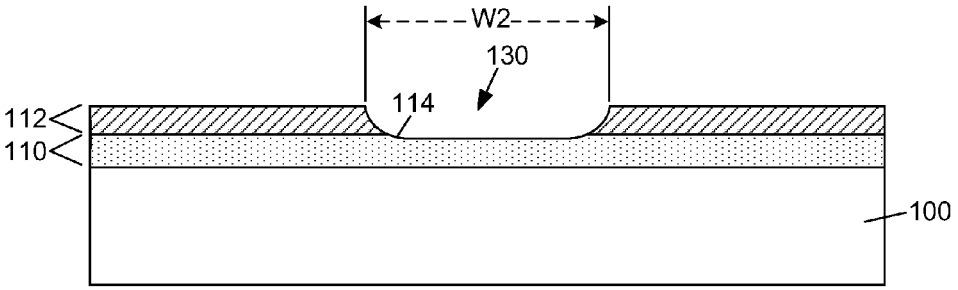

FIG. 5 is a schematic cross-sectional view from the perspective of second axis 1246 of FIG. 4 after etching of conductive layer 112 and removal of mask layer 120. After etching of conductive layer 112 and removal of mask layer 120, a resistor area 130 for a thermal resistor of the fluid ejection device, such as resistor 34 of fluid ejection device 30 (FIG. 2) is formed. Resistor area 130 is formed by removed portions of conductive layer 112 and has a shape corresponding to etch window 124. As FIG. 5 is a schematic cross-sectional view from the perspective of second axis 1246 of FIG. 4, a width W2 of resistor area 130 corresponds to a width W1 of reduced width portion 1247 of etch window 124. In one example, etching of conductive layer 112 may result in overetching of oxide layer 110, as represented by 114.

Figure 6:
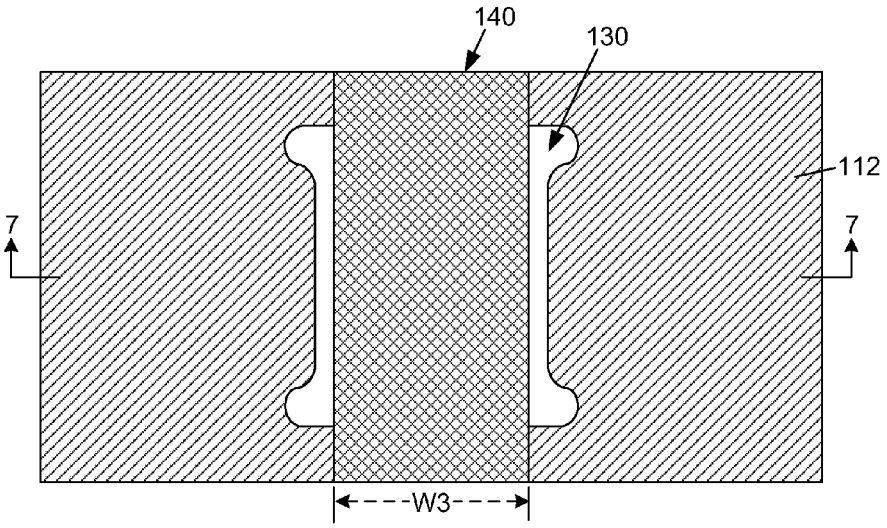

FIG. 6 is a schematic plan view of one example of a mask layer 140 used to define a width of a thermal resistor of the fluid ejection device, such as resistor 34 of fluid ejection device 30 (FIG. 2), after material (e.g., WSiN) of the thermal resistor has been deposited over conductive layer 112, and define conductive lines for a thermal resistor of the fluid ejection device, such as leads 35 for resistor 34 of fluid ejection device 30 (FIG. 2), in conductive layer 112. More specifically, mask layer 140 is formed over conductive layer 112 and the material of the thermal resistor, and is patterned to expose material to be removed. As such, mask layer 140 extends over and beyond resistor area 130 as formed from etch window 124. In one example, the exposed portions are removed by chemical etching. In one example, mask layer 140 is formed of photoresist and patterned using photolithography techniques, and the etch is a dry etch, such as a plasma-based fluorine (SF6) etch.

Figure 7:
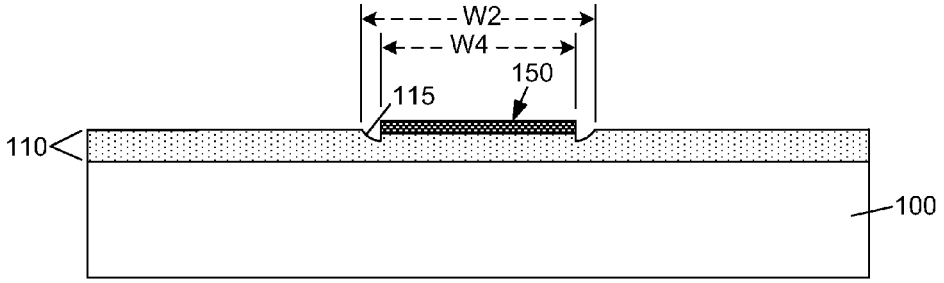

FIG. 7 is a schematic cross-sectional view from the perspective of line 7-7 of FIG. 6 after etching of the material of the thermal resistor and conductive layer 112, and removal of mask layer 140. After etching of the material of the thermal resistor and conductive layer 112, and removal of mask layer 112, thermal resistor 150 is defined. As FIG. 7 is a schematic cross-sectional view from the perspective of line 7-7 of FIG. 6, thermal resistor 150 has a width W4 corresponding to a width W3 of mask layer 140. As illustrated in FIG. 7, width W4 of thermal resistor 150 is less than width W2 of resistor area 130 as defined by reduced width portion 1247 of etch window 124 (FIG. 4). In one example, etching of the material of thermal resistor 150 and conductive layer 112 may, again, result in overetching of oxide layer 110, as represented by 115. In one example, such overetching results in thermal resistor 150 being formed on a "mesa" of oxide layer 110.

Figure 8:
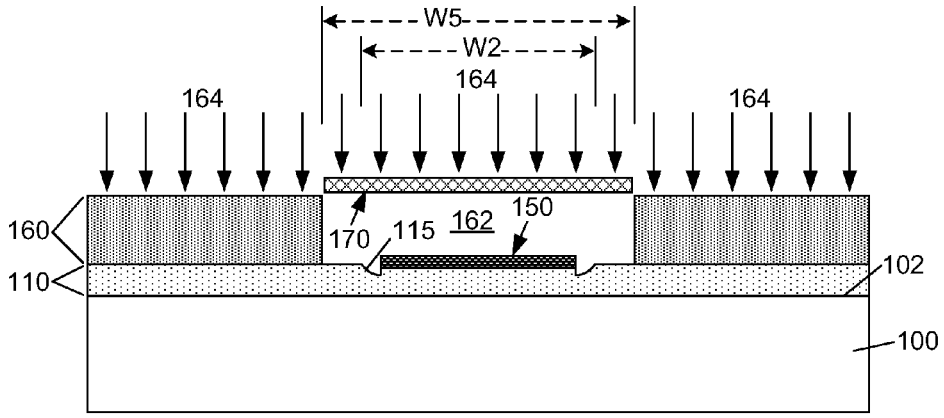

As illustrated in FIG. 8, a barrier layer 160, as an example of barrier layer 36 (FIG. 2), is formed on first side 102 of substrate 100. More specifically, barrier layer 160 is formed on first side 102 of substrate 100 over the thin-film structure (including oxide layer 100). Similar to fluid chamber 39 of barrier layer 36 (FIG. 2), barrier layer 160 forms a fluid chamber 162 encompassing thermal resistor 150.

In one example, barrier layer 160 is formed of a photo-imageable polymer such as SU8. As such, the photo-imageable polymer is polymerized by UV light, represented by arrows 164, to form barrier layer 160. In one example, fluid chamber 162 is formed by blocking UV light with a chamber mask 170, and preventing polymerization of the photo-imageable polymer in the area of fluid chamber 162.

In one example, and as illustrated in FIG. 8, width W2 of resistor area 130, as corresponding to width W1 of reduced width portion 1247 of etch window 124 (FIG. 4), is less than a width W5 of chamber mask 170. As such, stray reflections of UV light from surfaces of resistor area 150 are minimized during formation of barrier layer 160 and fluid chamber 162. More specifically, reflection of UV light from, for example, overetched areas of oxide layer 110 (e.g., overetching 115), are minimized since such areas are covered or "masked" by chamber mask 170. Thus, deformities and/or residue that may result from unintended polymerization of the photo-imageable material by stray reflections during formation of barrier layer 160 and fluid chamber 162 are minimized.

Figure 9:
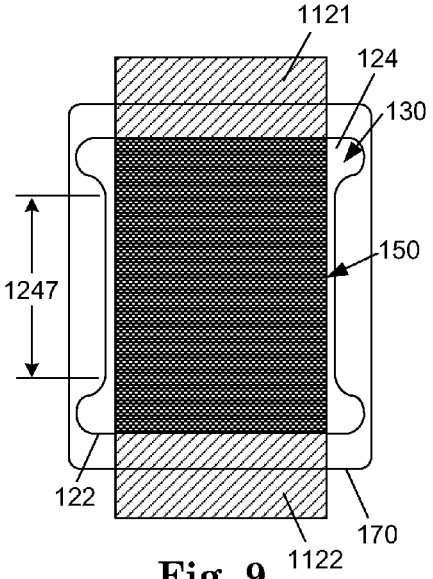
FIG. 9 schematically illustrates one example of an etch window of a resistor area mask in relation to a chamber mask for a fluid ejection chamber, and a resistor area and a resistor in association with conductive elements for the resistor.

FIG. 9 is a schematic plan view illustrating one example of etch window 124 (of etch mask 122 for resistor area 130) in relation to chamber mask 170 (for chamber layer 160 and fluid chamber 162). As illustrated in the example of FIG. 9, etch window 124 of etch mask 122, including reduced width portion 1247, is encompassed by chamber mask 170 such that chamber mask 170 surrounds or "encloses" etch window 124, including reduced width portion 1247. Thus, as described above, stray reflections of UV light during formation of chamber layer 160 and fluid chamber 162 (FIG. 8) are minimized since areas within etch window 124 of etch mask 122 (i.e., areas of resistor area 130) are covered or "masked" by chamber mask 170.

FIG. 9 also schematically illustrates one example of resistor area 130, as formed from etch window 124, and resistor 150, as patterned by mask layer 140 (FIG. 6), in association with conductive lines 1121 and 1122 for resistor 150, as formed from conductive layer 112 and patterned by mask layer 140 (FIG. 6). As illustrated in the example of FIG. 9, conductive lines 1121 and 1122 extend from opposite ends of resistor area 130. In addition, resistor 150 is positioned within resistor area 130 such that the reduced portion of resistor area 130, as defined by reduced width portion 1247 of etch window 124, extends along the edges or opposite sides of resistor 150.

Figure 10:
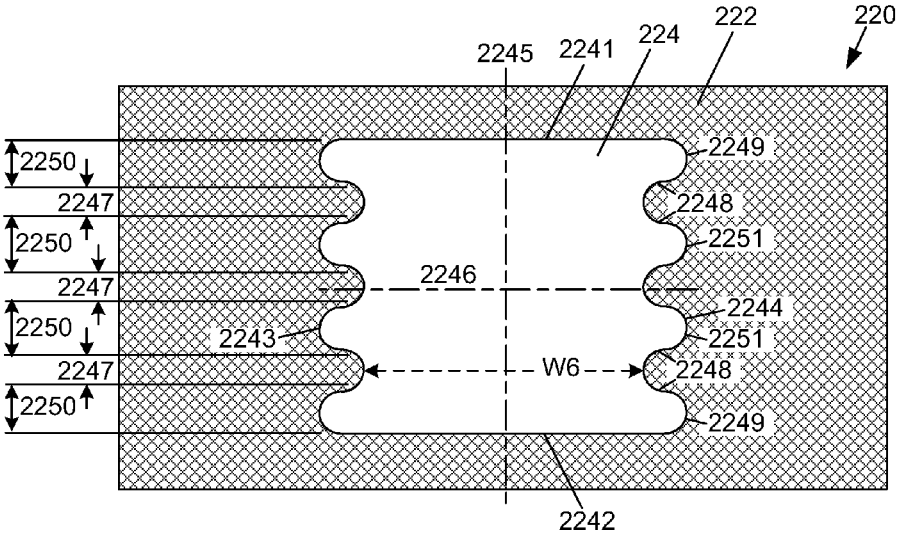
FIG. 10 is a schematic plan view of another example of a mask layer used to define an area for a resistor of a fluid ejection device.

FIG. 10 is a schematic plan view of another example of a mask layer 220 used to define an area for a thermal resistor of the fluid ejection device, such as resistor 34 of fluid ejection device 30 (FIG. 2). Similar to etch mask 122, etch mask 222 is patterned to define an etch window 224 through which material of conductive layer 112 (FIG. 3) is removed. In one example, similar to etch mask 122, etch mask 222 is formed off photoresist and patterned using photolithography techniques, and exposed areas or portions of conductive layer 112 are removed by chemical etching. In one example, the chemical etching is a dry etch, such as a plasma-based fluorine (SF6) etch.

As illustrated in the schematic plan view of FIG. 10, similar to etch window 124 of etch mask 122, etch window 224 of etch mask 222 has opposite ends 2241 and 2242, and opposite sides 2243 and 2244. In addition, etch window 224 of etch mask 222 has a first axis 2245 extending along a length thereof between opposite ends 2241 and 2242, and has a second axis 2246 extended along a width thereof between opposite sides 2243 and 2244.

In the example illustrated in FIG. 10, etch window 224 has a plurality reduced width portions 2247 provided between opposite ends 2241 and 2242 along the length thereof. More specifically, reduced width portions 2247 represent individual or discrete reduced width portions provided at spaced intervals along the length of etch window 224. Thus, reduced width portions 2247 constitute narrower width portions relative to and extending between wider width portions 2250 provided along the length of etch window 224. Accordingly, reduced width portions 2247 of etch window 224 are provided between wider width portions 2250 which represent "fingers" projecting along opposite sides 2243 and 2244 of etch window 224. As such, in the illustrated example, etch window 224 has a serpentine profile along opposite sides 2243 and 2244 over the length thereof. As illustrated in FIG. 10, reduced width portions 2247 each have a width W6. In one example, also as illustrated in FIG. 10, etch window 224 has radiussed portions 2248 provided at each end of reduced width portions 2247, and has radiussed portions 2249 provided at opposite ends 2241 and 2242 and radiussed portions 2251 provided at the ends of wider width portions 2250.

Figure 11:
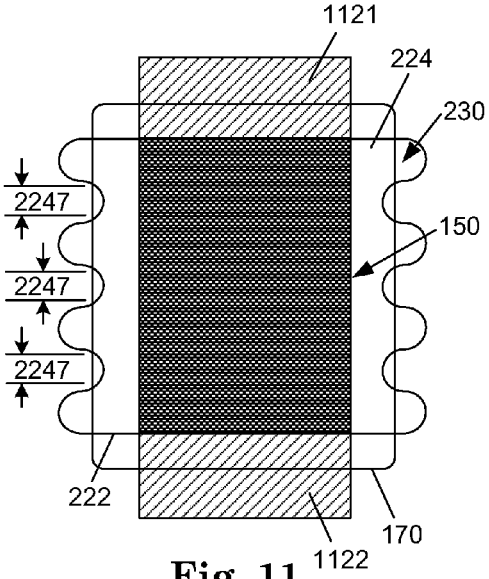
FIG. 11 schematically illustrates another example of an etch window of a resistor area mask in relation to a chamber mask for a fluid ejection chamber, and a resistor area and a resistor in association with conductive elements for the resistor.

FIG. 11 is a schematic plan view illustrating one example of etch window 224 (of etch mask 222 for resistor area 230) in relation to chamber mask 170 (for chamber layer 160 and fluid chamber 162). As illustrated in the example of FIG. 11, reduced width portions 2247 of etch mask 222 are encompassed by chamber mask 170 such that chamber mask 170 surrounds or "encloses" reduced width portions 2247. Thus, similar to that described above, stray reflections of UV light during formation of chamber layer 160 and fluid chamber 162 (FIG. 8) are minimized since areas within etch window 224 of etch mask 222 (i.e., areas of resistor area 230) are covered or "masked" by chamber mask 170. Accordingly, deformities and/or residue that may result from unintended polymerization of the photo-imageable material by stray reflections during formation of barrier layer 160 and fluid chamber 162 are minimized.

In addition, by providing etch mask 222 with the plurality of reduced width portions 2247, the etch rate along the sides of etch window 224 is slowed down such that surface angles of overetched areas (e.g., overetching 114 (FIG. 5)) are reduced. Accordingly, stray reflections of UV light which may develop during formation of chamber layer 160 and fluid chamber 162 will have a small reflected angle thereby minimizing possible reflection of the UV light back out of the photo-imageable material and, therefore, minimizing polymerization of unintended material.

FIG. 11 also schematically illustrates one example of resistor area 230, as formed from etch window 224, and resistor 150, as patterned by mask layer 140 (FIG. 6), in association with conductive lines 1121 and 1122 for resistor 150, as formed from conductive layer 112 and patterned by mask layer 140 (FIG. 6). As illustrated in the example of FIG. 11, conductive lines 1121 and 1122 extend from opposite ends of resistor area 230. In addition, resistor 150 is positioned within resistor area 230 such that the reduced width portions of resistor area 230, as defined by reduced width portions 2247 of etch window 224, extend along the edges or opposite sides of resistor 150.

Although specific examples have been illustrated and described herein, it will be appreciated by those of ordinary skill in the art that a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

What is claimed is:

1. A method of forming a fluid ejection device, comprising:
providing a substrate having a first side supporting an oxide layer and a conductive layer over the oxide layer; and
patterning the conductive layer to define an area for an actuator of the fluid ejection device, including shaping the area with first and second ends each having a first width and including closed radiussed portions at the first width, and at least one reduced width portion between the first and second ends having a second width less than the first width.

2. The method of claim 1, wherein shaping the area for the actuator comprises shaping the area with a plurality of reduced width portions between the first and second ends each having the second width less than the first width.

3. The method of claim 1, wherein shaping the area for the actuator comprises shaping the area with an I-shaped profile.

4. The method of claim 1, wherein shaping the area for the actuator comprises shaping the area with a serpentine profile along opposite sides thereof.

5. The method of claim 1, wherein shaping the area for the actuator comprises shaping the area with radiussed portions at each end of the at least one reduced width portion having the second width.

6. A method of forming a fluid ejection device, comprising:
providing a substrate having on a first side thereof an oxide layer and a conductive layer over the oxide layer; and
etching a portion of the conductive layer to define an area for a thermal resistor, including etching the conductive layer through an etch window having a length, closed radiussed portions at each end of the length, and at least one reduced width portion within the length to shape the area to have first and second ends each with a first width and each with closed radiussed portions at the first width, and at least one reduced width portion, between the first and second ends, with a second width less than the first width.

7. The method of claim 6, wherein the at least one reduced width portion of the etch window comprises a plurality of reduced width portions provided at spaced intervals along the length.

8. The method of claim 6, wherein the etch window has an I-shaped profile along the length.

9. The method of claim 6, wherein the etch window has a serpentine profile along opposite sides of the length.

10. The method of claim 6, wherein the etch window has radiussed portions at each end of the at least one reduced width portion.

11. The method of claim 6, further comprising:
forming the thermal resistor within the area; and
forming a chamber layer on the first side of the substrate, including patterning the chamber layer with a chamber mask to define a fluid ejection chamber encompassing the thermal resistor, wherein a width of the at least one reduced width portion of the etch window is less than a width of the chamber mask.

12. A fluid ejection device, comprising:
a substrate;
a thin-film structure formed on one side of the substrate, the thin-film structure including an oxide layer and a conductive layer formed over the oxide layer; and
a resistor area formed in the thin-film structure,
wherein the resistor area has a first axis extended along a length thereof between opposite ends and a second axis extended along a width thereof between opposite sides, wherein the opposite ends each have a first width and include closed radiussed portions at the first width, wherein the opposite sides form at least one reduced width portion having a second width less than the first width along the length of the resistor area between the opposite ends.

13. The fluid ejection device of claim 12, wherein the at least one reduced width portion comprises a plurality of reduced width portions along the length of the resistor area.

14. The fluid ejection device of claim 12, wherein the resistor area has radiussed portions at each end of the at least one reduced width portion.

15. A fluid ejection device, comprising:
a substrate;
a thin-film structure formed on one side of the substrate, the thin-film structure including an oxide layer and a conductive layer formed over the oxide layer;
a resistor area formed in the thin-film structure;
a thermal resistor formed in the resistor area; and
a fluid ejection chamber formed around the resistor area,
wherein the resistor area has a length, closed radiussed portions at each end of the length, and at least one reduced width portion along the length, wherein a width of the at least one reduced width portion of the resistor area is less than a width of the fluid ejection chamber.

16. The fluid ejection device of claim 15, wherein the at least one reduced width portion comprises a plurality of reduced width portions along the length of the resistor area.

17. The fluid ejection device of claim 15, wherein the resistor area has radiussed portions at each end of the at least one reduced width portion.

18. The fluid ejection device of claim 15, wherein the resistor area has an I-shaped profile, and includes a first axis extended along the length thereof between opposite ends each having a first width and a second axis extended along a width thereof between opposite sides, wherein the opposite sides form the at least one reduced width portion having a second width less than the first width along the length of the resistor area between the opposite ends.

19. The fluid ejection device of claim 12, wherein the resistor area has an I-shaped profile along the length thereof.

20. The fluid ejection device of claim 12, further comprising:

a thermal resistor formed in the resistor area; and a fluid ejection chamber having the resistor area defined therein, wherein a width of the at least one reduced width portion of the resistor area is less than a width of the fluid ejection chamber.

* * * * *